US005451145A

United States Patent [19]

Sauter

[11] Patent Number: 5,451,145

[45] Date of Patent: Sep. 19, 1995

[54] HIGH PRESSURE FLUID PUMP TRANSFORMER AND METHOD

[76] Inventor: William Sauter, 2002-A Guadelupe, Austin, Tex. 78705

[21] Appl. No.: 147,857

[22] Filed: Nov. 5, 1993

[51] Int. Cl.[6] ..... F04B 35/02

[52] U.S. Cl. ..... 417/225; 417/266; 417/267; 417/403; 417/534

[58] Field of Search ..... 417/225, 266, 267, 392, 417/403, 534

[56] References Cited

U.S. PATENT DOCUMENTS

| | | | |
|---|---|---|---|
| 157,617 | 12/1874 | Loretz | 417/225 |
| 2,296,647 | 9/1942 | McCormick | 417/225 |
| 2,897,762 | 8/1959 | Houvener | 417/392 |
| 2,970,546 | 2/1961 | White | 417/225 |
| 4,212,597 | 7/1980 | Mallofre | 417/225 |
| 4,523,895 | 6/1985 | Silva | 417/225 |
| 4,627,794 | 12/1986 | Silva | 417/225 |

*Primary Examiner*—Richard A. Bertisch
*Assistant Examiner*—William Wicker
*Attorney, Agent, or Firm*—Kenneth A. Roddy

[57] ABSTRACT

A high pressure fluid pumping transformer apparatus has a cylindrical transformer body surrounded by an outer pressure sleeve defining an annular working fluid chamber substantially surrounding the transformer body which receives fluid from an external source. The interior of the transformer body is divided into a central exhaust chamber and axially spaced working chambers at each end thereof. High pressure cylinders mounted in the transformer body at the end of each working chamber have a high pressure chamber spaced axially outward of the working chambers which contains a suction valve. Discharge valves mounted in the outer ends of the transformer body each contain a discharge valve and discharge port. An exhaust outlet extends from the exhaust chamber and is isolated from the working fluid chamber. A plunger reciprocally mounted in the transformer body has a portion which reciprocates in the working chambers and a reduced diameter at each end which reciprocates in the high pressure chambers. A shuttle valve slidably mounted on the transformer body moves in cooperation with the plunger to alternately open and close communication between the working fluid chambers. The working fluid pressure is used to compress all the internal components subject to internal fluid pressure fluctuations with a static pressure and at the same time supply the working fluid to the internal high pressure chambers to operate the plunger and also facilitates removal of heat from the seals and backup rings through which the plunger slides.

16 Claims, 3 Drawing Sheets

HIGH PRESSURE FLUID PUMP TRANSFORMER AND METHOD

BACKGROUND OF THE INVENTION

1. Field of the Invention

This invention relates generally to high pressure fluid pumping systems, and more particularly to a high pressure fluid pumping transformer and method for raising the pressure of a working fluid.

2. Brief Description of the Prior Art

Problems related to the fatigue failure of components are the limiting factor in current high pressure pump design. Reciprocating seals also pose problems due to wear but their replacement is typically simple and inexpensive relative to replacing metal components that fail from fatigue damage.

Heretofore fluid transformers, intensifiers and pumping systems, such as disclosed in U.S. Pat. Nos. 3,809,502 to Henry, 3,811,795 to Olsen, and 4,844,700 to Henderson, were not capable of operation continuously at pressures above that which caused stresses in its components greater than their fatigue life. The resulting extensive propagation of deep fractures into the body of components is obviously unacceptable.

Attempts have been made to solve the fatigue problem by supplying liquid tight chambers subject to internal pressure fluctuations and connecting this jacket to the discharge line of the pumping device. Typical high pressure pumps have a plurality of chambers into which a plunger reciprocates. Check valves are fitted in the chambers allowing flow into the chamber from a relatively low pressure source and out from the chamber into a relatively high pressure discharge conduit. All pumping chambers in the pump unit are connected to the discharge conduit and their relative progress through the reciprocating cycle is staggered so as to supply a relatively constant discharge flow to the discharge conduit. By surrounding the chamber with a jacket containing a relatively high pressure, the chamber stays in a state of compressive stress throughout its pumping cycle. This continuous output discharge pressure is limited by the fatigue life of the chamber and valve components. The chamber experiences pressure fluctuations from the inlet flow pressure to the discharge pressure. Other designs, such as disclosed in U.S. Pat. Nos. 3,370,545 to Waibel, 3,490,344 to Archer, 3,778,196 to Vereschagin et al, and 3,508,849 to Weber, have surrounded the suction/discharge valve assembly with a jacketed fluid at the discharge pressure to reduce their fatigue failure. These designs are limited by the compressive stress fatigue life of the valve components.

The present invention is distinguished over the prior art in general, and these patents in particular by a high pressure fluid pumping transformer apparatus which has a cylindrical transformer body surrounded by an outer pressure sleeve defining an annular working fluid chamber substantially surrounding the transformer body which receives fluid from an external source. The interior of the transformer body is divided into a central exhaust chamber and axially spaced working chambers at each end thereof. High pressure cylinders mounted in the transformer body at the end of each working chamber have a high pressure chamber spaced axially outward of the working chambers which contains a suction valve. Discharge valves mounted in the outer ends of the transformer body each contain a discharge valve and discharge port. An exhaust outlet extends from the exhaust chamber and is isolated from the working fluid chamber. A plunger reciprocally mounted in the transformer body has a portion which reciprocates in the working chambers and a reduced diameter at each end which reciprocates in the high pressure chambers. A shuttle valve slidably mounted on the transformer body moves in cooperation with the plunger to alternately open and close communication between the working fluid chambers. The working fluid pressure is used to compress all the internal components subject to internal fluid pressure fluctuations with a static pressure and at the same time supply the working fluid to the internal high pressure chambers to operate the plunger and also facilitates removal of heat from the seals and backup rings through which the plunger slides.

SUMMARY OF THE INVENTION

It is therefore an object of the present invention to provide a high pressure transformer system that will produce ultra high pressure flows of a fluid without fatigue failure of its components and to produce these flows with acceptable service life from the dynamic seals between the plunger or piston and the pressure chamber.

It is another object of this invention to provide a high pressure transformer apparatus which can be utilized in conjunction with existing currently available high pressure pumping equipment such as waterblast pumps to substantially increase the discharge pressure at a relatively small cost compared to conventional fluid intensifiers, pumps and transformers.

Another object of this invention is to provide a high pressure transformer apparatus which can be easily and quickly connected to existing high pressure pumping systems to develop ultra high pressure flows of fluid without requiring additional engines, motors, or mechanical transmissions.

A further object of this invention is to provide a high pressure pumping method for raising the pressure of a working fluid system having a range of from 10,000 to 20,000 psi to provide ultra high pressure flows greater than 20,000 psi.

A still further object of this invention is to provide a high pressure transformer apparatus which is simple in construction economical to manufacture, and rugged and reliable in operation.

Other objects of the invention will become apparent from time to time throughout the specification and claims as hereinafter related.

The above noted objects and other objects of the invention are accomplished by a high pressure fluid pumping transformer apparatus having a cylindrical transformer body surrounded by an outer pressure sleeve defining an annular working fluid chamber substantially surrounding the transformer body which receives fluid from an external source. The interior of the transformer body is divided into a central exhaust chamber and axially spaced working chambers at each end thereof. High pressure cylinders mounted in the transformer body at the end of each working chamber have a high pressure chamber spaced axially outward of the working chambers which contains a suction valve. Discharge valves mounted in the outer ends of the transformer body each contain a discharge valve and discharge port. An exhaust outlet extends from the exhaust chamber and is isolated from the working fluid chamber. A plunger reciprocally mounted in the transformer body has a portion which reciprocates in the working chambers and a reduced diameter at each end which reciprocates in the high pressure chambers. A shuttle valve slidably mounted on the transformer body moves in cooperation with the plunger to alternately open and close communication between the working fluid chambers. The working fluid pressure is used to compress all the internal components subject to internal fluid pressure fluctuations with a static pressure and at the same time supply the working fluid to the internal high pressure chambers to operate the plunger and also facilitates removal of heat from the seals and backup rings through which the plunger slides.

DESCRIPTION OF THE PREFERRED EMBODIMENT

Figure 1A:
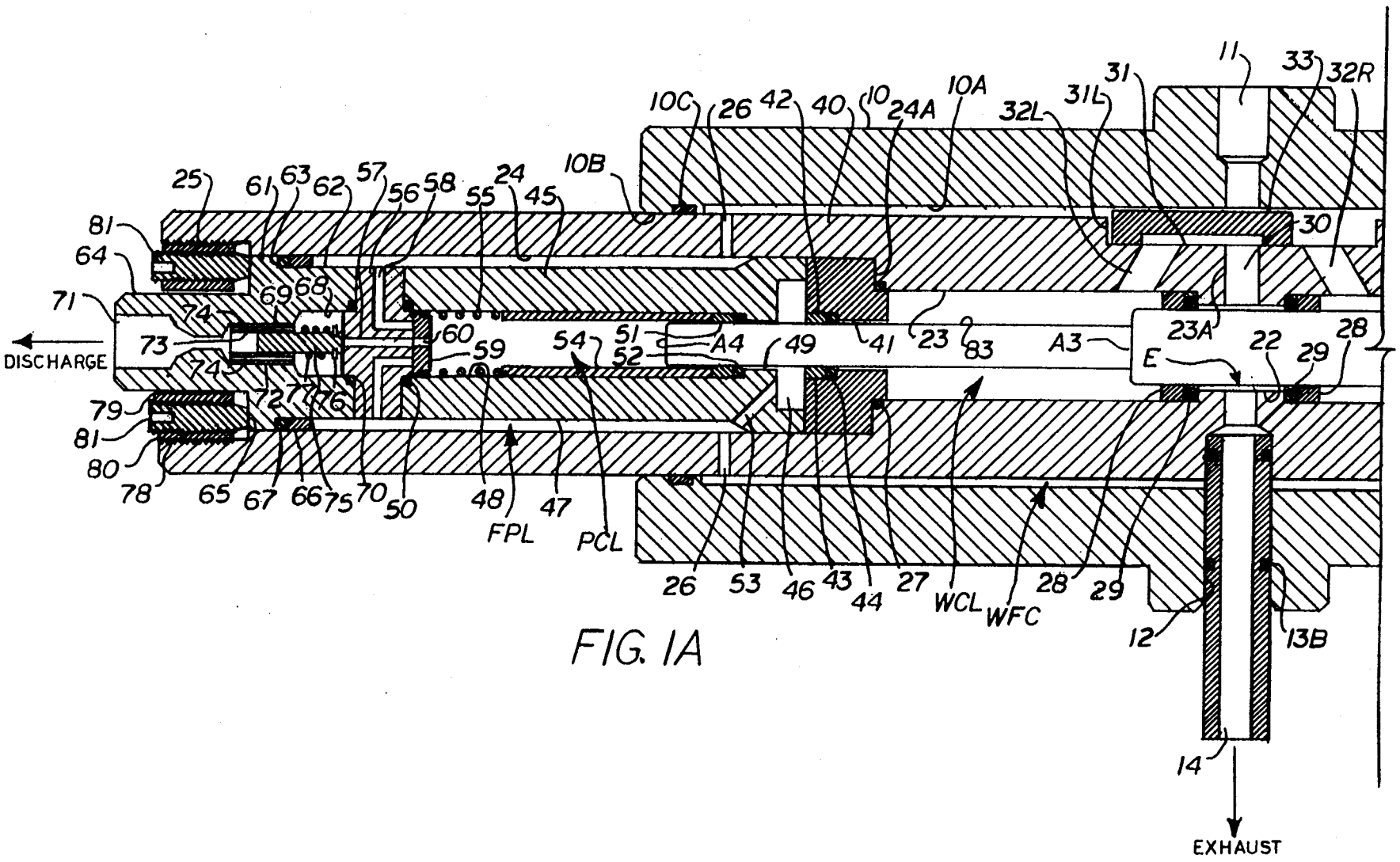
FIG. 1A and 1B combined is a longitudinal cross section of a high pressure transformer apparatus in accordance with the present invention, FIG. 1A being the left hand side and FIG. 1B being the right hand side of the apparatus.
Figure 1B:
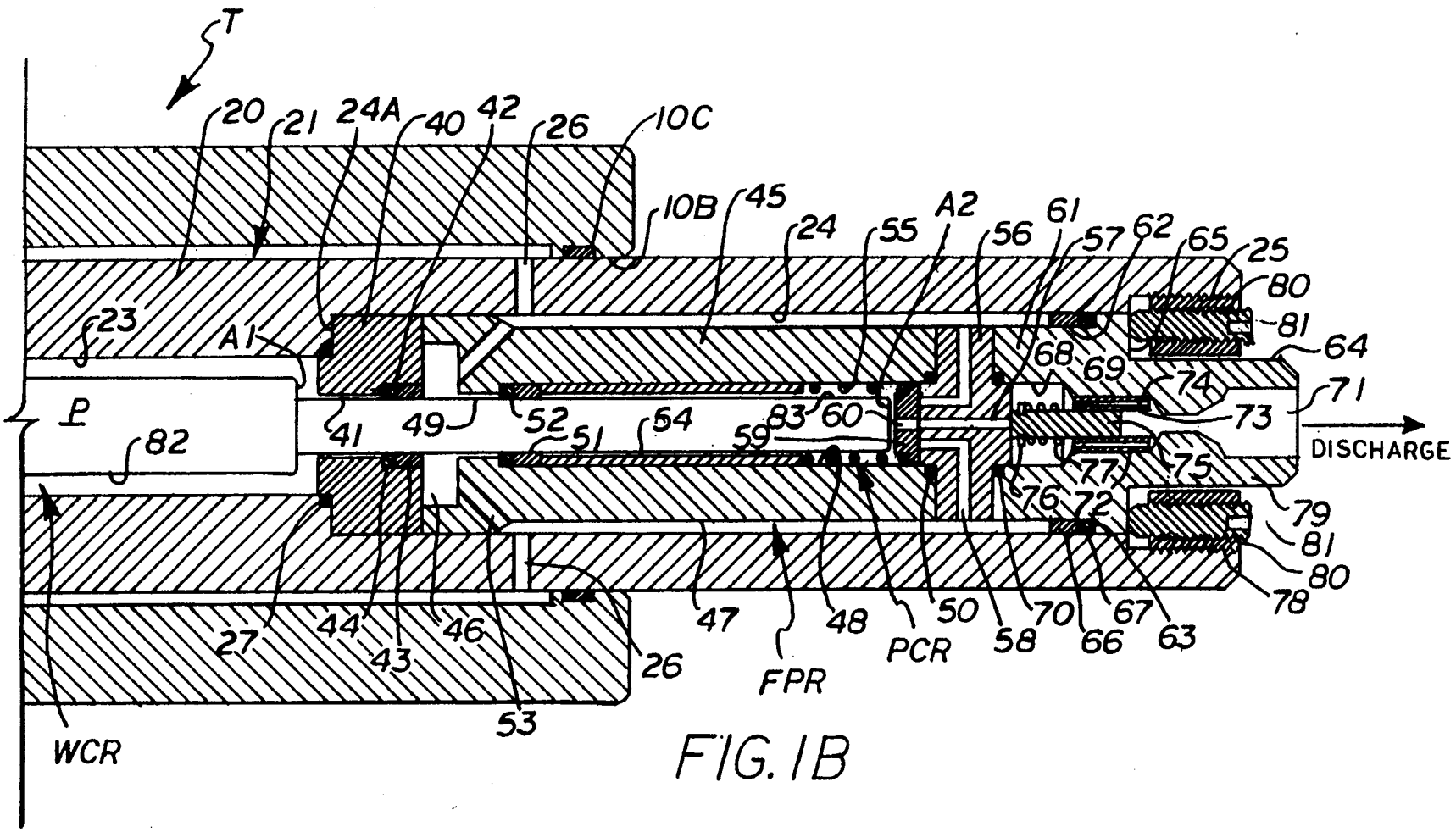
Figure 2:
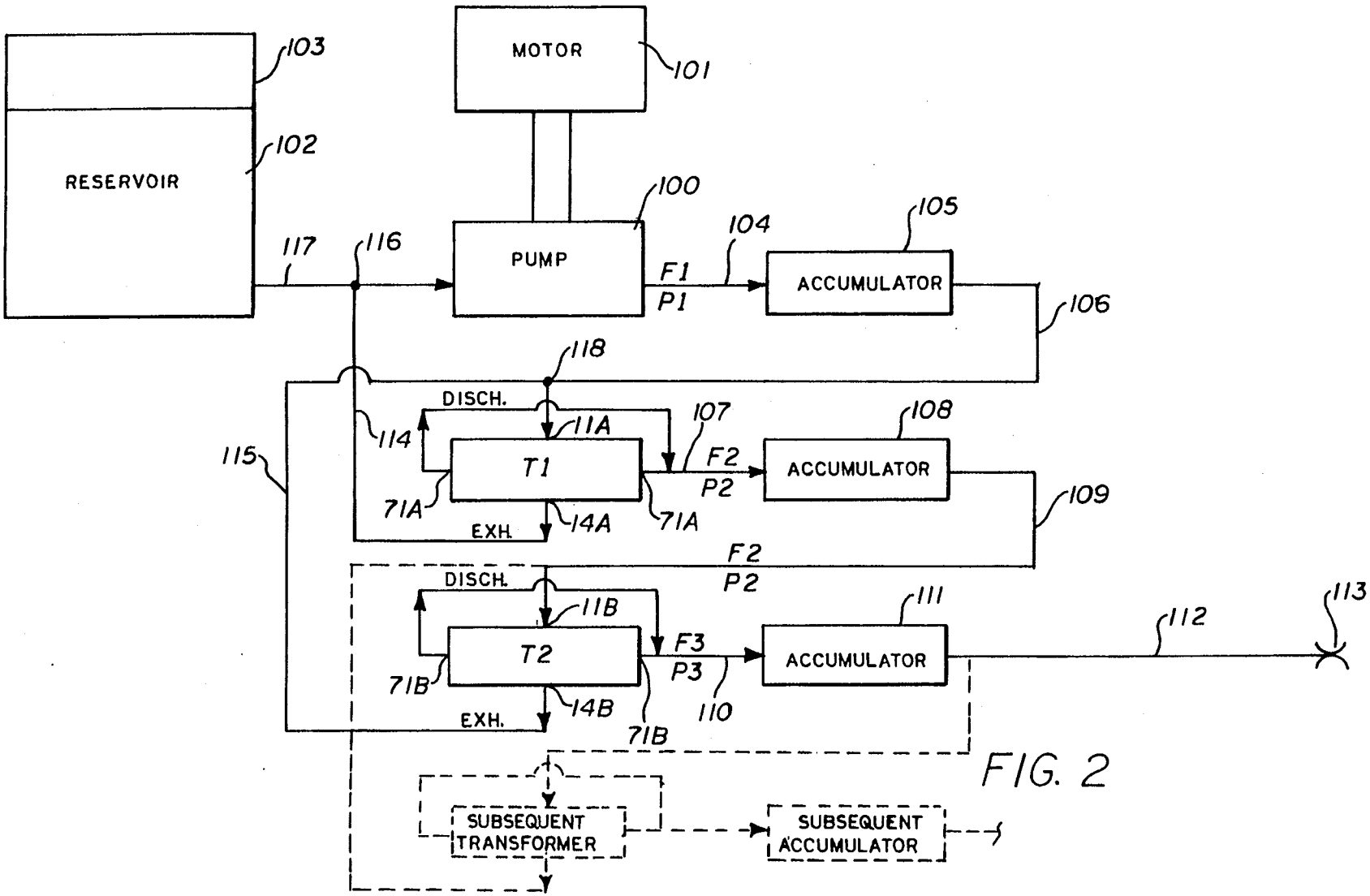
FIG. 2 is schematic illustration of a multiple transformer pump system in accordance with the present invention.

Referring to the drawings by numerals of reference, there is shown in FIGS. 1A–1B, a preferred high pressure transformer apparatus, and in FIG. 2, a high pressure transformer system comprising several transformers connected in series. The transformer apparatus will be described first followed by a description of its operation with reference to FIGS. 1A–1B , and then a description of the high pressure transformer system with reference to FIGS. 1A–1B and FIG. 2.

Referring now to FIGS. 1A–1B, there is shown a high pressure fluid transformer assembly T. The assembly comprises an outer cylindrical pressure sleeve 10 having a central longitudinal bore 10A and a reduced diameter bore 10B at each end. An elongate cylindrical transformer body 20 is mounted within the pressure sleeve 10 and extends outwardly from each end thereof defining an annular space 21 between the exterior of the transformer body 20 and the interior of the pressure sleeve 10. Seal members 10C mounted in the reduced diameter bores 10B engage the exterior of the transformer body 20 in fluid sealing relation.

An inlet port 11 extends through the side wall of the pressure sleeve 10 intermediate each end and receives fluid flow from an external source. As described in detail hereinafter, a bore 12 extends through the side wall of the pressure sleeve 10 intermediate each end and has an exhaust tube 13 mounted therein, the center of which serves as an exhaust port 14.

The cylindrical transformer body 20 has a first central bore 22, a second larger diameter bore 23 at each end of the bore 22 defining a shoulder 23A therebetween, a third larger bore 24 at each end of the bores 23 defining an annular shoulder 24A therebetween, and a fourth larger internally threaded bore 25 at each outer end of the bores 24. Passageways 26 extend radially outward from the bores 34 through the side wall of the transformer body 20 just inwardly from the seals 10C. A fluid seal ring 27 is mounted on the shoulder 24A between the bores 23 and 24. Seal rings 28 and backup rings 29 are engaged on the shoulder 23A at the inward end of the bores 23 and separate the interior of the transformer body 20 into right and left working chambers WCR and WCL, respectively, and isolate the bore 22.

A central exhaust passageway 30 extends transversly through the transformer body 20 in fluid communication with the bore 22. A central recess 31 on the exterior of the transformer body 20 defines a pair of laterally spaced stop shoulders 31R and 31L. A right and left working chamber port 32R and 32L, respectively, extend between the recess 31 and the right and left bores 23 with their outer ends spaced laterally inwardly of the stop shoulders 31R and 31L.

A shuttle valve 33 is slidably mounted in the recess 31 in the transformer body 20 and reciprocates between stop shoulders 31R and 31L. Reciprocating movement of the shuttle valve 33 in cooperation with the plunger P described below is accomplished by operating mechanisms which are conventional in the art and therefore not shown.

A disc-shaped spacer 40 having a reduced outer diameter at each end and a central bore 41 is engaged on each shoulder 24A at the inner end of each bore 24 and has a larger bore 42 extending inwardly from its outer facing end. The inner facing reduced diameter of the spacers 40 is received in the outer end of the bores 23 and form a sealing relation with the seals 27. Seal rings 43 and backup rings 44 are disposed in the bore 42 at the outer end of the spacers 40.

A high pressure cylinder 45 is received in each bore 24 and their inner ends engage the spacers 40. The inner ends of the high pressure cylinders 45 are counterbored and are received on the outer facing reduced diameters of the spacers 40 to define a chamber 46 between the outer ends of the spacers and the inner ends of the cylinders 45.

Each high pressure cylinder 45 has a reduced outer diameter 47 which extends from a tapered shoulder near their inner end to their outer end. The interior of each high pressure cylinder 45 has a longitudinal bore 48 extending from their outer end and terminating in a reduced diameter bore 49 which extends into the counterbore chamber 46. Seals 50 are mounted at the outer end of bores 48. Seal rings 51 and backup rings 52 are disposed in the inward end of the longitudinal bore 48. A pair of high pressure passageways 53 extend between the reduced diameter 47 of each high pressure cylinder 45 and the counterbore chamber 46 at the inner ends of the cylinders. A tubular spring spacer 54 is slidably received in the longitudinal bore 48 and its inward end is engaged on the backup rings 52. A compression spring 55 is received in each longitudinal bore 48 and their inward ends are engaged on the outer end of the spring spacers 54.

A disc-shaped valve seat 56 having a reduced diameter at each end is received in each bore 24 and is engaged on the outer end of each high pressure cylinder 45. The inner facing reduced diameter of the valve seats 56 extends a short distance into the bore 48 and engages the seals 50. Each valve seat 56 has a central discharge passageway 57 extending from end to end and a pair of suction passageways 58 which extend from the exterior of the valve seat to the face of the inward facing reduced diameter portion and establish a suction passageway between the bores 24 and the bores 48.

A disc-shaped suction valve 59 having a small central bore 60 is received in each bore 48 at the outer ends of the cylinders 45 and is engaged on the outer end of the compression springs 55. The outer face of each suction valve 59 is resiliently urged into engagement on the face of the inward facing reduced diameter of the valve seats 56 to normally close off the inward ends of suction passageways 58.

A generally cylindrical discharge manifold 61 is received in each bore 24 and engages the valve seats 56. The exterior of the discharge manifold 61 has a reduced diameter 62 at its inward end defining a radial shoulder 63 and a reduced diameter 64 at its outward end defining a radial shoulder 65. The shoulder 63 encloses the outer end of the bore 24 in the transformer body 20. A seal ring 66 and backup ring 67 are received on the inward facing shoulder 63 and reside at the outer ends of the bore 24. A counterbore 68 extends inwardly from the inner end of each discharge manifold 61 and terminates in a smaller bore 69. The counterbore 68 at the inner end of each discharge manifold is received on the outer facing reduced diameter of the valve seats 56. A seal ring 70 is installed between the outer reduced diameter of the valve seat 56 and the counterbore 68. An internally threaded discharge port 71 extends inwardly from the outer end of each discharge manifold 61 and communicates with the reduced bore 69.

A cylindrical valve guide 72 having a central bore 73 is received in each reduced bore 69 and has a pair discharge passageways 74 extending therethrough radially spaced from the central bore 73. The discharge passageways 74 establish communication between the discharge ports 71 and the counterbore 68. A valve rod 75 is slidably mounted in the central bore 73 of each valve guide 72 and has a snap ring 76 at its inward end. A compression spring 77 is received on the valve rod 75 and has one end engaged on the snap ring 76 and its other end on the inward facing surface of the valve guide 72 to normally urge the rod 75 into engagement with the outer facing surface of valve seats 56 and close off the discharge passageway 57 extending into the bore 48.

An externally threaded hold-down ring 78 having a central bore 79 is received on the reduced diameter 64 of each discharge manifold 61 and is threadedly engaged in the threaded bore 25 at the outer end of the transformer body 20. A plurality of circumferentially spaced threaded bores 80 extend through each hold-down ring 78 and receive set screws 81. The inward ends of the set screws 81 engage the outer facing shoulder 65 of the discharge manifolds 61. When screwed inwardly, the set screws 81 force the discharge manifolds 61, valve seats 56, high pressure cylinders 45, and spacers 40 inwardly against each other and force spacers 40 against the shoulders 24A in the transformer body 20. This action also compresses the seals 27, 50, and 70.

An elongate cylindrical plunger P is slidably mounted in the transformer body 20 for reciprocating motion. The plunger P has a central diameter 82 which is slidably received in the bore 22, through seals 28 and backup rings 29 and moves within the bores 23. The plunger P has a reduced diameter portion 83 at each end thereof which is slidably received through the bore 41 of spacer 40, seals 43 and backup rings 44, bore 49 and seals 51 and backup rings 52 of the high pressure cylinders 45 and moves within the bores 48. A right and left radial shoulder A1 and A3 are defined between the larger diameter 82 and the reduced diameter portion 83 of the plunger P and a right and left face A2 and A4 are defined at the outer end of the reduced diameter.

Having described the major components of the transformer assembly T, a brief discussion of the various chambers and flow paths defined therein will be undertaken.

As viewed in FIGS. 1A–1B, seals 28 and backup rings 29 separate the interior of the transformer body 20 into axially spaced right and left working chambers WCR and WCL respectively, and define a central exhaust chamber E therebetween. The larger diameter 82 of the piston P reciprocates in the working chambers WCR and WCL.

A right and left high pressure chamber PCR and PCL, respectively, is formed inside the transformer body 20 axially outward of the working chambers WCR and WCL which is defined by the longitudinal bore 48 in the high pressure cylinder 45, the inward end of the valve seat 56 and the seals 51 and backup rings 52. The reduced diameter 83 of the plunger P reciprocates in the high pressure chambers PCR and PCL.

A working fluid chamber WFC concentrically surrounding the transformer body 20 is defined between the exterior diameter of transformer body 20 and the interior bore 10A of the pressure sleeve 10 and the seals 10C at each end of the sleeve. Inlet port 11 is in fluid communication with the working fluid chamber WFC and receives fluid flow from an external source.

A right and left fluid flow passageway FPR and FPL concentrically surrounds the right and left high pressure cylinders 45, and is defined by the annulus between the interior bore 24 of the transformer body 20 and the exterior reduced diameter 47 of the high pressure cylinders 45, the exterior diameter of the valve seats 56, the reduced diameter 62 of the discharge manifolds 61, and the seals 66 and backup rings 67. The outer fluid flow passageways FPR and FPL communicate with the chambers 46 between the outer end of the spacers 40 and the inner end of the high pressure cylinders 45, through fluid passageways 53 extending through the side wall of the cylinders 45. The outer fluid flow passageways FPR and FPL also communicate with the central working fluid chamber WFC through fluid passageways 26 extending through the transformer body 20.

The backup rings 67 prohibit the seals 66 from extruding between the transformer body 20 and discharge manifolds 61, and backup ring 44 prohibits seal 43 from extruding between the plunger P and spacers 40 due to fluid pressure in the fluid flow passageways FPR and FPL. Similarly, backup ring 52 prohibits seal 51 from extruding between the reduced diameters 83 of plunger P and high pressure cylinders 45 due to fluid pressure in high pressure chambers PCR and PCL.

The exhaust passageway 30 extends transversly through the transformer body 20 and in communication with the exhaust chamber E (bore 22) at the center of the transformer body. The exhaust tube 13 extends through the bore 12 in the pressure sleeve 10 and into one end of the exhaust passageway 30. Seals 13A and 13B seal the exhaust tube 13 in the bore 12 and exhaust passageway 30. Thus, the exhaust passageway (center of tube 13) extends outwardly from the assembly and is isolated from the central working fluid chamber WFC. The other end of the exhaust port 30 is closed off to communication with the working fluid chamber WFC by the shuttle valve 33 in the recess 31.

The right and left working fluid chambers WCR and WCL are in alternating fluid communication with the central working fluid chamber WFC through ports 32R and 32L, respectively, as the shuttle valve 33 moves from right to left in the recess 31.

The shuttle valve 33 slidably mounted in the recess 31 in the transformer body 20 reciprocates between stop shoulders 31R and 31L in coordinated movement with the movement of plunger P. In the position shown in FIGS. 1A–1B, the shuttle valve 33 covers left working chamber port 32L and exhaust passageway 30 allowing them to communicate with one another but closes them off from the central working fluid chamber WFC. In this position, the shuttle valve 33 allows communication between the right-hand working fluid chamber WCR and the central working fluid chamber WFC through right-hand port 32R.

The seals which the plunger P slides through in its reciprocating motion are preferrably formed of a polymer such as Teflon (TM, E.I. DuPont de Nemours & Co.) filled with molybdenum disulfide and fiberglass or ultra high molecular weight polyethylene or similar material. A bronze or lead material that will elastically deform under the action of a high fluid pressure and resist cold flow or extrusion would also be suitable for use. The backup rings through which the plunger slides have a close sliding fit on the plunger surface and are designed to prohibit the extrusion of their adjacent seals between the backup rings and the plunger P. The preferred backup rings are formed of bronze, aluminum bronze, or beryllium copper. The seals may be of conventional V-ring or Chevron type design.

OPERATION

In operation, the inlet port 11 of the pressure sleeve 10 is connected to a source of fluid, such as water, which is used to facilitate cooling of the seals which are subject to reciprocating motion, hereinafter referred to as the "working fluid". The incoming "working fluid" substantially surrounds the transformer body 20 and is maintained at a pressure greater than the fluid exiting through the exhaust port creating the pressure differential that drives the plunger assembly.

Referring still to FIGS. 1A–1B, the larger diameter 82 of the plunger P moves due to the action of a pressure differential between the left and right working chambers WCL and WCR, respectively. The incoming working fluid is received by inlet port 11, into the outer portion of working fluid chamber WFC and is directed to either the left or right working chamber WCL or WCR through port 32L or port 32R by the shuttle valve 33. When one port is opened by the shuttle valve 33, the other port is opened to communication to the exhaust passageway 30. The fluid in the working chamber (WCL) which is not receiving fluid from the working fluid chamber WFC is discharged through the working chamber port (32L), under the shuttle valve 33, through exhaust passageway 30, through central exhaust chamber E in the transformer body 20 and exits the transformer body through exhaust port 14.

The working fluid from working fluid chamber WFC also flows to the right end (FIG. 1B) of the pressure sleeve 10, through transformer body passageway 26 and into flow passage FPR substantially surrounding the high pressure cylinder 45, into the chamber 46 between the spacer 40 and the inward end of the high pressure cylinder 45, and through the suction passageway 58 in the valve seat 56 to suction valve 59. This fluid is at the same pressure as fluid in inlet port 11. When the plunger assembly is moving to the left such as to increase the volume of high pressure chamber PCR, the pressure differential between valve seat suction passage 58 and chamber PCR causes the suction valve 59 to move to the left (inward) against the force of spring 55 opening the valve seat suction passage 58 and allowing the working fluid to fill the high pressure chamber PCR.

Thus, during operation, the incoming working fluid is maintained at a pressure greater than the fluid exiting through the exhaust port 14 creating the pressure differential that drives the plunger P. It should be noted that the working fluid is also in contact with the low pressure side of the seals 28, 43, and 51, and their respective backup rings 29, 44, and 52 to facilitate their cooling.

During the time the plunger P is moving to the left, working chamber WCR receives fluid from working fluid chamber WFC through right working chamber port 32R. The pressure in working chamber WCR forces the larger diameter portion 82 of plunger P into left working chamber WCL which is at a low pressure relative to right working chamber WCR. The plunger P continues to move to the left until it reaches the end of its stroke. The shuttle valve 33 is then moved to the right against stop 31R allowing the fluid in working chamber WCR to exit through exhaust port 14.

When the plunger P is moving to the left the pressure of the working fluid reacts on the area of right-hand plunger shoulder A1 and face A2, the area of the left-hand shoulder A3 reacts with fluid at the exhaust tube pressure, and the area of the left-hand face A4 reacts with fluid at the discharge pressure. The summation of right-hand shoulder area A1 and face A2 multiplied by the pressure of the working fluid forces the plunger assembly against the summation of the exhaust flow pressure multiplied by left-hand shoulder area A3 and the discharge pressure multiplied by left-hand plunger face area A4. Expressed mathematically, where WP=working pressure, EP=exhaust pressure, and DP=discharge pressure:

$$(A1+A3)\ X\ (WP)=(A2)\ X\ (EP)+(A4)\ X\ (DP)$$

The exhaust pressure is very low relative to the working fluid pressure therefore the discharge pressure will be substantially higher than the working fluid pressure.

After the plunger P reaches the end of its stroke to the left and the shuttle valve 33 is moved to close port 32R, port 32L is opened to communicate with working fluid chamber WFC.

The working fluid in the working fluid chamber WFC is now directed to the left end of the pressure sleeve 10, through transformer body passageway 26 and into flow passage FPL substantially surrounding the left-hand high pressure cylinder 45, into the chamber 46 between the spacer 40 and the inward end of the high pressure cylinder 45, and through the suction passageway 58 in the left-hand valve seat 56 to the left-hand suction valve 59 and causes the left-hand suction valve 59 to move to the right (inward) against the force of spring 55 opening the valve seat suction passage 58 and allowing the working fluid to fill the left-hand high pressure chamber PCL. As fluid pressure in the left-hand high pressure chamber PCL increases and the fluid volume in the right-hand pressure chamber PCR decreases, the plunger P will move to the right. As the plunger P begins to move to the right, the right-hand spring 55 pushes the right-hand valve 59 into spring biased engagement on the right-hand valve seat 56 closing off the suction passageways 58 in the valve seat and preventing fluid from flowing from high pressure chamber PCR through the suction passageways 58.

As the plunger P moves to the right, fluid pressure in high pressure chamber PCR will increase and discharge valve rod 75 will move to the right allowing flow from high pressure chamber PCR to go through valve guide discharge passageways 74 and be discharged through discharge port 71 at the outer end of the transformer body 20. When the plunger P reaches the end of its stroke to the right, the shuttle valve 33 is shifted to the right covering port 32R and exhaust passageway 30 starting the cycle again.

It should be noted that during operation, the working fluid pressure is used to compress the high pressure cylinders 45, valve seats 56, and discharge manifolds 61 with a static pressure and at the same time supply the working fluid to the high pressure chambers PCR and PCL on their suction stroke. The working fluid pressure can be increased by an amount that is only slightly less than that pressure which initiates the onset of fatigue damage to the transformer components. This will be explained in greater detail hereinafter in the description of a series transformer system.

During the suction stroke (when the plunger P moves to the left), the high pressure cylinder 45 has the pressure of the working fluid on all its surfaces and resulting forces are in equilibrium. During the discharge stroke (when the plunger P moves to the right), the pressure in the high pressure chamber PCR may be raised to a pressure that creates a pressure differential between the interior and exterior of high pressure cylinder 45 that is slightly less than the pressure corresponding to the material fatigue limit of the cylinder 45. The discharge pressure is the sum of this pressure differential and the working fluid pressure. This feature allows discharge pressures which would likely cause fatigue damage to components in other high pressure pumping systems. The maximum pressure differential seen by the seals 51 and backup rings 52 in the high pressure chambers PCR and PCL in the pressure cycle from the working fluid pressure to the discharge pressure is the same as that for the high pressure cylinder 45. Current seal designs can operate under these conditions satisfactorily.

The seals 43 and backup rings 44 in the spacers 40 and the right working chamber WCR experience pressure fluctuations from the working fluid pressure to the exhaust pressure. The pressure fluctuations in the right and left working chambers are less than that associated with the onset of fatigue failure in transformer components, specifically the transformer body 20. The transformer body 20 is compressed by the working fluid in working fluid chamber WFC. The exhaust fluid pressure is maintained at a value less than that of the working fluid pressure yet close enough to the working fluid pressure to avoid fatigue damage to the components of the transformer assembly.

Thus, from the foregoing description, it can be seen that all components subject to internal pressure fluctuations are compressed by an external fluid pressure reducing their susceptibility to fatigue damage, and pressure differentials experienced by components are limited to values less that that which would initiate the onset of fatigue failure at high pressures and unlimited cycles. Another feature of the present invention is the presence of the flow of the working fluid contacting the seals and backup rings surrounding the reciprocating parts. This facilitates the removal of heat from the seals and backup rings. The efficient removal of heat results in cooler operating temperatures and significantly increase the operating life of the seals.

OPERATION OF MULTIPLE TRANSFORMER SYSTEM

A plurality of the high pressure fluid transformers T may be connected in series to generate pressures in a flow of fluid in multiples of pressures that produce stresses equal to the fatigue stresses in pumping apparatus without suffering fatigue failure of the transformer components.

Referring now additionally to FIG. 2, there is shown a fluid pump 100 driven by conventional mechanical input power such as an engine or motor 101 which receives a flow of water from a water supply 102 in reservoir 103 through conduit 117 and outputs a flow F1 with pressure P1 in conduit 104.

Flow F1 is received in an accumulator 105 and is discharged through conduit 106. A first transformer T1 receives flow F1 through inlet port 11A. The discharge flow F1 in typical positive displacement pumps varies sinusoidally. The accumulator 105 dampens the flow fluctuations in flow F1.

Flow F2 is discharged from the first transformer T1 through discharge ports 71A which are joined together into one stream (conduit 107) and the flow F2 is received into accumulator 108. Flow F2 at pressure P2 is discharged from accumulator 108 through conduit 109 and is received by a second transformer T2 through inlet port 11B. Flow F3 at pressure P3 is discharged from the second transformer T2 through conduit 110 and is received by a third accumulator 111. Flow F3 is then discharged by the third accumulator 111 through conduit 112 and through nozzle 113 into the atmosphere. Nozzle 113 is of sufficiently small orifice diameter to cause a pressure P3 much greater than atmospheric pressure in conduit 112. The pressure drop through nozzle 113 is proportional to the velocity of the fluid flow into the atmosphere.

Conduits 114 and 115 are connected to the exhaust ports 14A and 14B of transformers T1 and T2, respectively. An exhaust flow from transformer T1 flows to junction 116. At junction 116 the fluid from conduit 114 goes into conduit 117 between the reservoir 103 and pump 100 and into pump 100. The exhaust flow from the second transformer T2 goes through conduit 115 to junction 118, joining conduit 106 and into transformer T1 through inlet port 11A.

By linking transformers T1 and T2 together in series and connecting their respective exhaust ports 71A and 71B as described, no component in the system, including the shuttle valves and plunger seals (FIGS. 1A–1B) are subject to pressure fluctuations greater than that which would cause fatigue failure in its components. Furthermore no component is subject to pressure differentials great enough to cause failure (i.e. exceeding the elastic limit of its material).

In the case of the first transformer T1, the pressure difference between the inlet port 11A and and the discharge ports 71A is less than the pressure that would cause fatigue damage of components in the first transformer T1. The ratio of these pressures is determined by the relative difference in the plunger shoulder area (A1 or A3) and the plunger face area (A2 or A4) (FIGS. 1A–1B).

The pressure in exhaust port 14A is determined by the operating pressure of the inlet to pump 100. Conduit 114 delivers exhaust flow to conduit 117 where it flows into pump 100. The pressure differential between inlet port 11A and exhaust port 14A is the same as that generated by pump 100 and is less than the pressure difference corresponding to the fatigue failure of the pump or transformer components.

The second transformer T2 in series receives flow from the first transformer T1 through conduit 109 at inlet port 11B. Inlet port 11B has a fluid pressure of the discharge of the first transformer T1. The fluid discharged from the second transformer T2 has a fluid pressure greater than the pressure in inlet port 11B and less than that which would create fatigue failure. Flow exits exhaust port 14B with a pressure equal to the inlet port 11A pressure of the first transformer T1. Thus, the pressure differential between the inlet port 11B and the exhaust port 14B of the the second transformer T2 is approximately equal to the pressure differential created in the first transformer T1 between inlet port 11A and exhaust port 14A.

Referring again to FIGS. 1A–1B, the fluid pressure from the inlet port 11 surrounds and compresses the transformer body 20, the high pressure cylinders 45, the valve seats 56, and portions of the discharge manifolds 61. This fluid from port 11 also supplies fluid to the high pressure chambers PCR and PCL. The fluid pressure in high pressure cylinders 45 cycles between the inlet port 11 fluid pressure and the discharge port 71 fluid pressure regardless of the difference from atmospheric pressure.

Working chambers WCR and WCL are subject to cycling pressure differentials as the working fluid forces the plunger P back and forth. The fluid pressure in working chambers WCR and WCL cycles between inlet fluid pressure at inlet port 11 and the exhaust pressure at exhaust port 14. The differential pressure acting on the shuttle valve 33 is the pressure differential of inlet port 11 and exhaust port 14.

With reference to FIG. 2, the exhaust port 14B of the second transformer T2 is connected to the inlet port 11A of the first transformer T1 by conduit 115. Therefore the fluid pressure at exhaust port 14B of the second transformer T2 is equal to the fluid pressure at the inlet port 11A of the first transformer T1. This pressure is less than the inlet pressure to the second transformer T2 by the pressure difference of inlet port 11A and discharge ports 71A of the first transformer T1. The second transformer T2 is thus not subjected to cycling stresses in any of its components that are greater than the fatigue limit of their materials and are not subject to stresses that exceed the elastic limit of their materials.

While only two transformer and accumulator sets have been shown in FIG. 2, it should be understood that more than two sets may be connected as described above to provide increasingly higher pressures. For example, a subsequent transformer may have its inlet connected to the discharge of the previous accumulator to receive the working fluid discharged therefrom and its exhaust connected to the working fluid supplied to the previous transformer and its first and second discharge valve connected to a subsequent accumulator to discharge the working fluid at a higher pressure level than the pressure level of the fluid received. The subsequent fluid accumulator would receive the working fluid discharged from the subsequent transformer at the higher pressure level and dampen the fluid flow fluctuations in the fluid and discharge it at the higher pressure level.

From the foregoing description, it can be seen that the high pressure transformer of the present invention provides an inexpensive, reliable device to produce high pressure flows of fluid. Furthermore, the present invention generates a high pressure fluid flow while reducing the possibility of fatigue failure or exceeding the elastic limit of its components. The present invention also provides an economical method for producing high pressure fluid flows with currently available pumping equipment.

Although the above description provides an example of one preferred embodiment of the invention, other variations are possible. For example, the invention may be used to provide a high flow of fluid from a high pressure input supply of a lower flow rate. The invention may also be built using only one high pressure chamber.

While this invention has been described fully and completely with special emphasis upon a preferred embodiment, it should be understood that within the scope of the appended claims the invention may be practiced otherwise than as specifically described herein.

I claim:

1. A pressure intensifier adapted for connection to a source of working fluid at a first pressure level and to a discharge line for increasing the pressure of the working fluid from the first pressure level and discharging it at a second pressure level comprising;

a cylindrical fluid transformer body having axially opposed first and second working chambers, axially opposed first and second high pressure chambers, and an exhaust passageway extending to the exterior of said transformer body, an annular central working fluid chamber surrounding said first and second working chambers and a first and second working fluid annular surrounding said first and second high pressure chambers and in fluid communication with said central working fluid chamber, said central working fluid chamber having an inlet to receive fluid at a first level from an external fluid source, first and second suction valve means operatively connected with each respective said high pressure chamber, first and second discharge valve means operatively connected with each said high pressure chamber, a reciprocating plunger slidably and sealably mounted in said fluid transformer body and having a central portion movable within said first and second working chambers and an outer portion at each end thereof movable in said first and second high pressure chambers, said plunger having first and second pressure areas at each respective end, said transformer body, suction valve means, and discharge valve means being so arranged with inlet and outlet passage means as to receive pressurized working fluid from said central working fluid chamber at a first pressure level alternately into said first working chamber and first high pressure chamber and said second working chamber and second high pressure chamber, to cause said plunger to reciprocate between opposite first and second end positions in said transformer body, control valve means operatively connected with said exhaust passageway and said central working fluid chamber and movable in cooperation with said plunger to alternately open and close communication between said central working fluid chamber and said first and second working chambers and to alternately open and close communication between said first and second working chambers and said exhaust passageway while preventing fluid communication between said exhaust passageway and said central working fluid chamber, said working fluid being received through said inlet into said central working fluid chamber and said first and second working fluid annuluses and to each said suction and discharge valve means and directed by said control valve means into one of said first or second working chambers while the other said first or second said working chamber which is not receiving fluid is opened to exhaust fluid through said exhaust passageway to the exterior of said transformer body to create a pressure differential between said first and second working chambers, such that upon a sufficient pressure differential, the working fluid in one said working chamber acting on said plunger first pressure area to move said plunger in one direction and upon movement said plunger increasing the volume of the high pressure chamber at the end from which said plunger is moving to cause the respective said suction valve to open allowing said working fluid to fill said high pressure chamber at the end from which said plunger is moving, and while said plunger is moving in one direction, the pressure of said working fluid at the first level reacts on the combined said first and second pressure areas at the end of said plunger facing the direction from which it is moving, said first pressure area at the end of said plunger facing the direction of plunger movement reacts with fluid at the exhaust pressure, and said second pressure area at the end of said plunger facing the direction of plunger movement compresses the working fluid which was drawn into the opposed said high pressure chamber during the previous plunger stroke to a second pressure level substantially higher than said working fluid at the first pressure level, and said discharge valve opening upon the compressed fluid in said high pressure chamber reaching the second pressure level to discharge the fluid at the second pressure level from said transformer body, and upon said plunger reaching the end of its stroke, said control valve means being moved to open communication between the filled said working chamber and said exhaust passageway and between said central working fluid chamber and the previously exhausted said working chamber and to each said suction and discharge valve means to create a pressure differential between said first and second working chambers such that the direction of plunger movement is reversed.

2. A pressure intensifier according to claim 1 in which said working fluid first pressure level is of sufficient pressure to compress said working chambers and said high pressure chambers with a static pressure during operation of said pressure intensifier while simultaneously supplying the working fluid to said high pressure chambers on the suction stroke of said plunger.

3. A pressure intensifier according to claim 2 in which said working fluid is a liquid and serves to facilitate removal of heat from the reciprocating members of said pressure intensifier and their related seal means.

4. A pressure intensifier according to claim 1 in which said cylindrical fluid transformer body has a central bore in fluid communication with said exhaust passageway, said first and second working chambers are disposed at opposite ends of said central bore, said first and second high pressure chambers are disposed one at each outer end of each said working chamber, each said suction valve means is disposed at the outer end of each said high pressure chamber, and each said discharge valve means is disposed at each outer end of said transformer body axially outward from each said suction valve means.

5. A pressure intensifier according to claim 4 in which said reciprocating plunger has a first central diameter and a reduced diameter portion at each end thereof defining an annular shoulder at each end of said first central diameter, said annular shoulders defining said first pressure areas of said plunger which react with fluid within said first and second working chambers and the outer face of each said reduced diameter portion defining said second pressure areas of said plunger which react with fluid within said first and second high pressure chambers, the combined said first and second pressure areas at one end of said plunger reacting with the working fluid filling said working chamber and high pressure chamber at one end of said transformer body to move said plunger in one direction, and when said plunger is moving in one direction, the opposed said first pressure area reacting with the working fluid within the opposed said working chamber being exhausted of fluid, and said second pressure area of said plunger facing the direction of plunger movement reacts with working fluid within the opposed said high pressure chamber to compress the working fluid to the discharge pressure level, whereby the sum of said pressure areas facing the direction from which said plunger is moving multiplied by the pressure of said working fluid at the first level forces said plunger against the sum of the exhaust pressure multiplied by the area of said first pressure area facing the direction of movement and the discharge pressure multiplied by said second pressure facing the direction of movement.

6. A pressure intensifier according to claim 1 in which said central working fluid chamber comprises an annular cavity concentrically surrounding said first and second working chambers in said transformer body, and each said first and second working fluid annulus comprises an annular cavity concentrically surrounding said first and second high pressure chambers.

7. A pressure intensifier according to claim 6 in which said exhaust passageway comprises an exhaust port extending transversly through said transformer body in fluid communication with said control valve at one end and has an exhaust conduit at its opposite end extending from said transformer body exhaust chamber and to the exterior through said central working fluid chamber isolated from said central working fluid chamber to exhaust fluid from said exhaust port to the exterior of said transformer body.

8. A pressure intensifier according to claim 1 in which said central working fluid chamber is defined by a hollow cylindrical outer pressure sleeve concentrically mounted on said transformer body substantially surrounding the exterior thereof and sealingly engaged at each end thereon to define an annular cavity surrounding said working chambers in said transformer body and having an inlet in fluid communication with said cavity, and first and second fluid passageways extending from respective said first and second working chambers to the exterior of said inner transformer body in fluid communication with said annular cavity.

9. A pressure intensifier according to claim 8 in which said control valve means comprises a shuttle valve slidably mounted on said transformer body and movable in coordination with said plunger to alternately open and close communication between said exhaust passageway and said first and second fluid passageways and between said annular cavity and said first and second fluid passageways while constantly closing off communication between said exhaust passageway and said annular cavity.

10. A pressure intensifier according to claim 1 in which said suction valve means comprises a valve seat in said transformer body at the outer end of each said high pressure chamber and having suction passageways extending through said valve seat between said high pressure chamber and the respective said first and second working fluid annulus, a suction valve element movably mounted in each said high pressure chamber and movable between a closed position against said valve seat preventing fluid communication through said suction passageways between the respective said high pressure chamber and the respective said working fluid annulus and an open position allowing fluid communication therebetween, spring means mounted in each said high pressure chamber to normally urge said valve element to the closed position, and said suction valve element being moved away from said valve seat to the open position upon said plunger moving away from said valve to create a pressure drop in said high pressure chamber.

11. A pressure intensifier according to claim 10 in which said valve seat and said suction valve element each have a coaxial discharge passageway extending therethrough isolated from said suction passageways, and each said discharge valve means comprises a discharge valve manifold mounted in said transformer body outwardly from the outer end of each said valve seat, a discharge port at the outer end of each said valve manifold, and a plurality of discharge passageways extending through said valve manifold in fluid communication with said valve seat and said suction valve element discharge passageways and with said discharge port, a valve rod member slidably mounted in said discharge valve manifold and movable between a closed position against said valve seat discharge passageway preventing fluid communication through said discharge passageways between the respective said high pressure chamber and the respective said discharge port and an open position allowing fluid communication therebetween, spring means mounted on each said valve rod member to normally urge said valve rod member to the closed position, and said valve rod member being moved away from said valve seat to the open position upon said plunger moving toward said valve seat to create sufficient fluid pressure in the respective said high pressure chamber to overcome the spring force and allow the fluid in the respective said high pressure chamber to be discharge through said discharge passageways and said discharge port.

12. A pressure intensifier system adapted for connection to a source of working fluid at a given pressure level and to a discharge line for increasing the pressure of the fluid from the given pressure level and discharging it at an increased pressure level comprising;

a plurality of pressure intensifiers as defined in claim 1 operatively connected in series to generate sequentially increasing discharge fluid pressure levels, a first fluid accumulator which receives a working fluid from a fluid source and dampens the fluid flow fluctuations in the fluid received and discharges it at a first pressure level, a first said transformer body having its said inlet connected to the discharge of said first accumulator to receive the working fluid discharged at the first level, its said exhaust passageway connected to the working fluid supplied to said first accumulator, and its said first and second discharge valve means connected to a second accumulator to discharge the working fluid at a second pressure level, a second fluid accumulator which receives the working fluid discharged from said first transformer body at the second pressure level and dampens the fluid flow fluctuations in the fluid and discharges it at the second pressure level, a second said transformer body having its said inlet connected to the discharge of said second accumulator to receive the working fluid discharged at the second pressure, its said exhaust passageway connected to the working fluid supplied to said first transformer body, and its said first and second discharge valve means connected to a third accumulator to discharge the working fluid at a third pressure level, a third fluid accumulator which receives the working fluid discharged from said second transformer body at the third pressure level and dampens the fluid flow fluctuations in the fluid and discharges it at the third pressure level.

13. A pressure intensifier system according to claim 12 including nozzle means connected with said third accumulator for discharging the working fluid received from said third accumulator into the atmosphere and having an orifice of sufficient size to cause a pressure greater than the atmospheric pressure such that the pressure drop through said nozzle is proportional to the velocity of the fluid flow into the atmosphere.

14. A pressure intensifier system according to claim 12 including another said transformer body having its said inlet connected to the discharge of said third accumulator to receive the working fluid discharged therefrom, its said exhaust passageway connected to the working fluid supplied to said second transformer body, and its said first and second discharge valve means connected to another accumulator to discharge the working fluid at a higher pressure level than the pressure level of the fluid received, and another fluid accumulator which receives the working fluid discharged from said another transformer body at the said higher pressure level and dampens the fluid flow fluctuations in the fluid and discharges it at the said higher pressure level.

15. A pressure intensifier system according to claim 14 including nozzle means connected with said another accumulator for discharging the working fluid received from said another accumulator into the atmosphere and having an orifice of sufficient size to cause a pressure greater than the atmospheric pressure such that the pressure drop through said nozzle is proportional to the velocity of the fluid flow into the atmosphere.

16. A pressure intensifier system according to claim 14 including a subsequent said transformer body having its said inlet connected to the discharge of said another accumulator to receive the working fluid discharged therefrom, its said exhaust passageway connected to the working fluid supplied to said another transformer body, and its said first and second discharge valve means connected to a subsequent accumulator to discharge the working fluid at a higher pressure level than the pressure level of the fluid received, and a subsequent fluid accumulator which receives the working fluid discharged from said subsequent transformer body at the said higher pressure level and dampens the fluid flow fluctuations in the fluid and discharges it at the said higher pressure level, said subsequent transformer body and subsequent accumulator serving to receive the working fluid from said another accumulator and supply working fluid to said another transformer body and to discharge the working fluid as recited at increasingly higher levels than the pressure level of the fluid received by said another accumulator.

* * * * *